US008979184B2

(12) United States Patent
Stafford et al.

(10) Patent No.: US 8,979,184 B2
(45) Date of Patent: Mar. 17, 2015

(54) SWIVEL CAMP CHAIR

(76) Inventors: Todd W. Stafford, Maryville, TN (US); Michael Allison, Maryville, TN (US)

( * ) Notice: Subject to any disclaimer, the term of this patent is extended or adjusted under 35 U.S.C. 154(b) by 164 days.

(21) Appl. No.: 13/215,804

(22) Filed: Aug. 23, 2011

(65) Prior Publication Data

US 2013/0049410 A1 Feb. 28, 2013

(51) Int. Cl.

| | |
|---|---|
| ***A47C 3/18*** | (2006.01) |
| ***A47C 4/28*** | (2006.01) |
| ***A47C 7/68*** | (2006.01) |
| ***A47C 9/10*** | (2006.01) |

(52) U.S. Cl.

CPC ... *A47C 3/18* (2013.01); *A47C 7/68* (2013.01); *A47C 9/105* (2013.01)

USPC ..... 297/16.2; 297/344.26

(58) Field of Classification Search

CPC ..... A47C 3/18

USPC ..... 297/16.2, 344.21, 344.22, 344.26

See application file for complete search history.

(56) References Cited

U.S. PATENT DOCUMENTS

| | | | | |
|---|---|---|---|---|
| 3,905,642 | A * | 9/1975 | Simjian | 297/344.26 |
| 4,482,184 | A | 11/1984 | Mincey | |
| 4,557,520 | A * | 12/1985 | Simjian | 297/344.26 X |
| 4,772,068 | A | 9/1988 | Gleckler et al. | |
| 4,824,170 | A | 4/1989 | Goldmeier | |
| 4,971,392 | A | 11/1990 | Young | |
| 5,078,451 | A | 1/1992 | Sobel | |
| 5,110,184 | A | 5/1992 | Stein et al. | |
| 5,364,163 | A | 11/1994 | Hardison | |
| 5,567,014 | A | 10/1996 | Fitch | |
| 6,048,029 | A | 4/2000 | Percoco | |
| 6,095,607 | A | 8/2000 | Wensel | |
| 6,315,360 | B1 | 11/2001 | Guerrini | |
| 6,520,579 | B2 * | 2/2003 | Kassai et al. | 297/344.22 X |
| 6,575,532 | B2 | 6/2003 | Almerico | |
| 6,773,070 | B2 | 8/2004 | Worledge et al. | |
| 6,890,033 | B1 | 5/2005 | Casella | |
| 7,032,965 | B2 | 4/2006 | Howell et al. | |
| 7,549,702 | B2 * | 6/2009 | Meyers | 297/16.2 X |
| 7,717,514 | B2 | 5/2010 | Redmann | |
| 8,272,684 | B2 * | 9/2012 | Obolewicz et al. | 297/16.2 |
| 2002/0117878 | A1 | 8/2002 | Fox | |
| 2009/0174233 | A1 * | 7/2009 | Hoffman et al. | 297/16.2 |

OTHER PUBLICATIONS

HuntMore. Printed Jul. 22, 2011. "360° Chair", http://huntmore.biz.

HuntMore. Printed Jul. 22, 2011. "Big Feet", http://huntmore.biz/360stool/bigfeet.html.

(Continued)

*Primary Examiner* — Anthony D Barfield

(74) *Attorney, Agent, or Firm* — J. Kenneth Hoffmeister; Merchant & Gould

(57) ABSTRACT

A camp chair that levels to accommodate uneven ground and swivels. In the various embodiments, the camp chair includes a swivel assembly between the seat and the legs. The camp chair collapses into a compact portable configuration for transportation and expands into an operable seating configuration. The length of each leg is individually adjustable to allow leveling of the camp chair for use on an uneven or inclined surface. The camp chair optionally includes attachment points for connecting accessories. The swivel assembly allows the seat and any attachments to rotate freely about the vertical axis of the camp chair.

20 Claims, 6 Drawing Sheets

(56) References Cited

OTHER PUBLICATIONS

HuntMore. Printed Jul. 22, 2011. "Silent Adjustment", http://huntmore.biz/360stool/silent.html.
HuntMore. Printed Jul. 22, 2011. "Comfort", http://huntmore.biz/360stool/comfort.html.
HuntMore. Printed Jul. 22, 2011. "Backrest", http://huntmore.biz/360stool/backrest.html.
HuntMore. Printed Jul. 22, 2011. "Collapsible", http://huntmore.biz/360stool/collapsible.html.
HuntMore. Printed Jul. 22, 2011. "360° Rotation", http://huntmore.biz/360stool/360.html.
Curt Wells, "Tried & True", Bowhunter, Apr./May 2010, pp. 22, 24.
International Search Report and the Written Opinion of the International Searching Authority, Dec. 7, 2012.

* cited by examiner

SWIVEL CAMP CHAIR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

1. Field of Invention

The present invention relates to chairs. More specifically, the present invention relates to portable, temporary seating.

2. Description of the Related Art

Temporary seating offers convenience due to the ability to be collapsed or folded into a compact configuration for portability and storage. One style of temporary seating generally referred to as a "camp chair" has gained considerable popularity for outdoor activities due, in part, to light weight and excellent portability. Some of the various activities where a camp chair may find use include sitting around a camp fire, watching a sporting event, waiting in a hunting blind, or fishing from a bank. While the sidelines of a soccer field may be relatively flat and even, the bank near a good fishing spot may be steeply inclined and/or uneven. A conventional camp chair is not well suited to be used on inclined or uneven surfaces. Additionally, the collapsible support structure of a conventional camp chair that allows the chair to collapse and become portable also dictates that the seating area remain stationary and facing in one direction. During a sporting event, the location of the action may frequently change position relative to the field of view of the spectator or the action may be concentrated in a single location for substantial periods of time punctuated by occasional and brief changes in position. In either case, the spectator will generally position the chair facing the playing field and shift in the seat to follow the action. In a special case of a sporting event where the spectator may be centrally located and the action occurs around the spectator, such as a stock car race, the spectator will be unable to easily observe the action occurring behind the spectator if the spectator remains in the chair.

BRIEF SUMMARY

The following Brief Summary is provided to introduce a selection of concepts in a simplified form that are further described below in the Detailed Description. This Brief Summary is not intended to identify key features or essential features of the claimed subject matter, nor is it intended to be used to limit the scope of the claimed subject matter.

In the various embodiments, the camp chair includes a swivel assembly between the seat and the legs. The camp chair collapses into a compact portable configuration for transportation and expands into an operable seating configuration. The length of each leg is individually adjustable to allow leveling of the camp chair for use on an uneven or inclined surface. The camp chair optionally includes attachment points for connecting accessories. The swivel assembly allows the seat and any attachments to rotate freely about the vertical axis of the camp chair. When collapsed into the portable compact configuration, the camp chair can be stored in a bag or other similar container for protection and ease of portability.

The camp chair includes an upper frame, a lower frame, a swivel assembly, and a seat. The swivel assembly operatively connects the upper frame to the lower frame and includes a rotary bearing that allows the upper frame and the lower frame to rotate independently. An optional swivel lock selectively locks the top member to the bottom member to temporarily prevent the rotation of the top member relative to the bottom member. A number of arms connected to the top member of the swivel assembly support a seat. The arms have a curvilinear shape selected to position and support the seating surface at the proper height when the camp chair is expanded into an operational seating configuration and to minimize the effective lateral dimension of the camp chair when collapsed into a portable compact configuration.

Three or more legs connected to the bottom member of the swivel assembly support the camp chair. To reduce the likelihood that a leg will be inadvertently moved from the support position during use, the camp chair optionally includes a leg lock system. In order to level the camp chair on inclined or uneven surfaces, the length of each leg is individually adjustable. The outer tubular member and inner tubular member are operably connected for telescopic adjustment. A leg length lock mechanism locks to fix the axial position of the inner tubular member relative to the outer tubular member and unlocks to allow the inner tubular member to slide axially relative to the outer tubular member.

The camp chair optionally includes attachment points on the swivel assembly for the mounting accessories to the camp chair. Each accessory generally includes a functional portion supported by an accessory arm configured to be selectively secured to one of the attachment points. Examples of suitable accessories include a side table, a camera mount, a fan, an umbrella mount, a gun rest, a fishing rod mount, and a television or radio mount.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

A camp chair that levels to accommodate uneven ground and swivels, according to the present invention is described herein with reference to the accompanying figures. In the various embodiments, the camp chair includes a swivel assembly between the seat and the legs. The camp chair collapses into a compact portable configuration for transportation and expands into an operable seating configuration. The length of each leg is individually adjustable to allow leveling of the camp chair for use on an uneven or inclined surface. The camp chair optionally includes attachment points for connecting accessories. The swivel assembly allows the seat and any attachments to rotate freely about the vertical axis of the camp chair.

Figure 1:
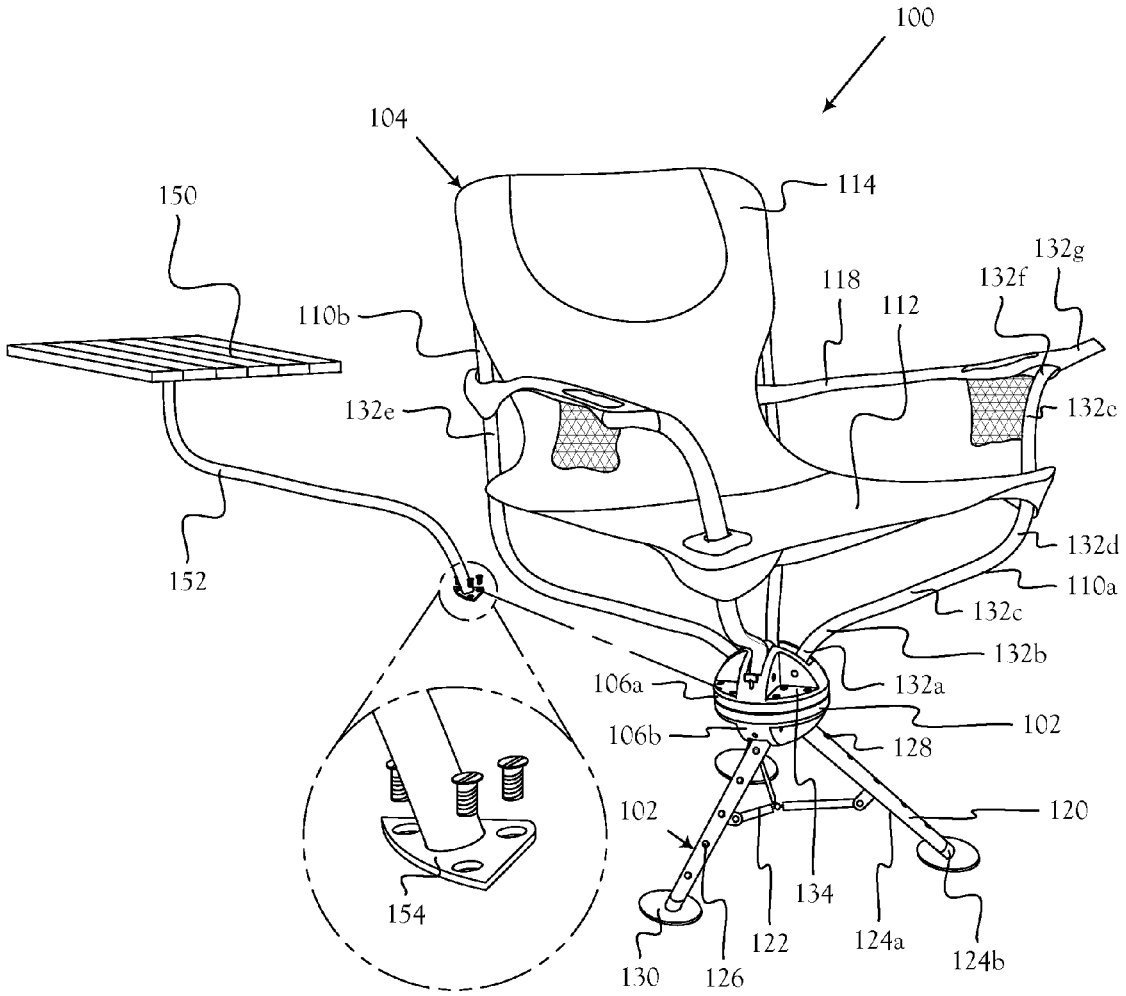
FIG. 1 shows a perspective view of one embodiment of the camp chair in the operable seating configuration with an optional accessory.

FIG. 1 illustrates a perspective view of one embodiment of the camp chair 100 in the operable seating configuration. The camp chair 100 includes an upper frame, a lower frame, a swivel assembly 102, and a seat 104. The swivel assembly 102 generally includes a top member 106*a* and bottom member 106*b* configured to rotate independently of each other. The swivel assembly 102 operatively connects the upper frame to the lower frame, which allows the upper frame and the lower frame to rotate independently. The upper frame includes a number of arms 110*a*, 110*b* connected to the top member 106*a* of the swivel assembly 102. In one embodiment, the arms 110*a*, 110*b* include a pair of front arms 110*a* and a pair of rear arms 110*b*. In the illustrated embodiment, the seat 104 includes a seating surface 112, a backrest 114, and a pair of armrests 118. The backrest 114 and the armrests 118 are both optional and one or both may be omitted as desired. Each front arm 110*a* engages the seat 104 proximate to the front corners of the seating surface 112 and engages each armrest 118 proximate to the front edge of the armrest 118. Each rear arm 110*b* engages the seat 104 proximate to the rear corners of the seating surface 112 at a location behind the intersection of the seating surface 112 and the backrest 114 and engages the backrest 114 proximate to the top corners of the backrest 114. The seat 104 is attached to each of the arms 110*a*, 110*b* in a manner that generally precludes the non-destructive removal of the seat 104 from the camp chair 110. The attachment of the seat 104 to four arms 110*a*, 110*b* reduces the amount of force applied to each point of attachment and also allows the seating surface 112 to generally assume a traditional quadrilateral shape.

The lower frame includes three or more legs 120 that are connected to the bottom member 106*b* of the swivel assembly 102 and cooperatively interface with the support surface, such as the ground or a floor, to support the camp chair 100. The camp chair 100 is easily leveled when engaging the support surface at only three points. In the illustrated embodiment, the camp chair 100 includes three legs 120 that are substantially linear. Each leg 120 is pivotally connected to the swivel assembly 102 and oriented at an angle of approximately 120° relative to the other legs 120. To place the chair in the operable seating configuration, each leg 120 is moved from the collapsed position in alignment with the vertical axis of the swivel assembly 102 to a support position. When in the support position, the legs 120 cooperatively form a tripod that supports the camp chair 100. Each leg 120 is oriented to form an acute angle with the vertical axis of the swivel assembly 102. The size of the angle between the legs 120 and the vertical axis of the swivel assembly 102 is selected to balance stability, which is directly proportional to the angle between the legs 120 and the vertical axis of the swivel assembly 102, with load capacity, which is inversely proportional to the angle between the legs 120 and the vertical axis of the swivel assembly 102.

To reduce the likelihood that a leg 120 will be inadvertently moved from the support position during use, the camp chair 100 optionally includes a leg lock system 122. One embodiment of a leg lock system 122 employs bracing that selectively hold the legs 120 in the support position. The leg lock system 122 illustrated in FIG. 1 includes a brace attached to each leg 120. The opposite ends of the braces are hinged together requiring the braces, and hence the legs 120, to be collapsed and expanded as a group. When expanded, the braces offer resistance against lateral forces that might move a leg 120 from the support position and render the camp chair 100 unstable. When collapsed, the braces tend to hold the legs 120 in the collapsed position. In an alternate embodiment, the leg lock system employs mechanical engagement between the pivot end of each leg and the bottom member 106*b* that increases the amount of force required (e.g., a ball detent) or requires physical removal (e.g., a locking pin) to dislodge each the leg from either or both of the support position and the collapsed position.

In order to level the camp chair 100 on inclined or uneven surfaces, the length of each leg 120 is individually adjustable. In one embodiment, each leg 120 includes an outer tubular member 124*a* and an inner tubular member 124*b*. The outer diameter of the inner tubular member 124*b* is less than the inner diameter of the outer tubular member 124*a*. The outer tubular member 124*a* and inner tubular member 124*b* are operably connected for telescopic adjustment. A leg length lock mechanism locks to fix the axial position of the inner tubular member 124*b* relative to the outer tubular member 124*a* and unlocks to allow the inner tubular member 124*b* to slide axially relative to the outer tubular member 124*a*. In one embodiment, the leg length lock mechanism is a push button 128 lock including a plurality of holes 126 axially spaced apart along the length of the outer tubular member 124*a* and a push button 128 biased to normally extend outward from the inner tubular member 124*b*. The push button 128 engages one of the holes 126 to fix the relative positions of the inner tubular member 124*b* and the outer tubular member 124*a*. Pressing the push button 128 disengages the lock and allows adjustment of the relative positions of the inner tubular member 124*b* and the outer tubular member 124*a*.

In one embodiment, each leg 120 includes a foot 130 connected to the terminal end of the leg 120. The foot 130 increases the contact area with the surface to reduce the likelihood that the leg 120 will dig into a support surface with a soft composition (e.g., dirt or mud). In an alternate embodiment, the terminal end of leg 120 carries a foot 130 that is pivotally (e.g., by a pivot pin) or rotationally (e.g., by a ball joint) connected. The articulation of the feet 130 allows the base to conform to irregularities in the surface.

The curvilinear shape of the arms 110*a*, 110*b* is selected to position and support the seating surface 112 at the proper height (nominally about 16 inches) when the camp chair 100 is expanded into an operational seating configuration. The curvilinear shape of the front arms 110*a* and the rear arms 110*b* is also selected to minimize the effective width of the front arms 110*a* and the rear arms 110*b* to allow the camp chair 100 to assume an elongated profile suitable for portability when the camp chair 100 is collapsed into a portable compact configuration.

Each rear arms 110*b* has three elongated regions. While the elongated regions are generally linear in some embodiments, the elongated regions have some curvature in other embodiments. The first elongated region 132*a* is the pivot end that is operably connected to the top member 106*a*. A first curved region 132*b* provides a transition from the first elongated region 132*a* transitions to the second elongated region 132*c*. The second elongated region 132*c* provides the primary horizontal extension for each rear arms 110*b* when the camp chair 100 is in the operable seating configuration. A second curved region 132*d* provides a transition from the second elongated region 132*c* to the third elongated region 132*e*. The third elongated region 132*e* provides the primary vertical extension of each rear arms 110*b* and serves as the support for the backrest 114 when the camp chair 100 is in the operable seating configuration. The rear arms 110*b* are designed such that the axis of the third elongated region 132*e* lies substantially parallel to the vertical axis of the swivel assembly 102 when the camp chair 100 is in the operable seating configuration. In one embodiment, this is achieved when the angle between the third elongated region 132*e* and the second elongated region 132*c* and the angle between the first elongated region 132*a* and the third elongated region 132*e* are complimentary angles. In an alternate embodiment in which the camp chair 100 configured as a stool and omits the backrest 114 and the armrests 118, the third elongated region 132*e* is omitted or reduced in length.

The front arm 110*a* is similar in configuration to the rear arm 110*b* but does exhibit some differences. Notably, the length of the third elongated region 132*e* of the front arm 110*a* is smaller. Additionally, the front arm 110*a* includes a third curved region 132*f* that provides a transition from the third elongated region 132*e* to a fourth elongated region 132*g*. The fourth elongated region 132*g* extends horizontally and services as the front anchor point for the armrest 118. In an alternate embodiment of the camp chair 100 omitting the armrests 118, the third curved region 132*f* and the fourth elongated region 132*g* are also omitted and the third elongated region 132*e* of the front arm 110*a* is omitted or reduced in length.

FIG. 1 shows a side table accessory 150 suitable for attachment to the camp chair 100 at one of the optional attachment points 134 on the swivel assembly 102 The attachment points 134 are components of the swivel assembly 102 and need not be included in all embodiments of the camp chair 100. Attachment points 134 located on the upper member allow the accessory to rotate with the seat 104. Attachment points 134 located on the bottom member allow the accessory to remain stationary while the seat 104 rotates. The accessory generally includes a functional portion supported by an accessory arm 152. One end of the accessory arm 152 includes a mounting plate 154 configured to be selectively secured to one of the attachment points 134. Examples of accessories 150 include, but are not limited to, the side table shown in FIG. 1, a camera mount, a fan, an umbrella mount, a gun rest, a fishing rod mount, a television or radio mount. In one embodiment, the accessory is directly attached to the accessory arm. In an alternate embodiment, the accessory is selective attachable to the accessory arm allowing different types of accessories to be used without having to switch out the entire accessory and accessory arm assembly. In some embodiments, the accessory 150 is supported by more than accessory arm 152. In other embodiments, the accessory arm mounts to more than one attachment point 134.

Figure 2:
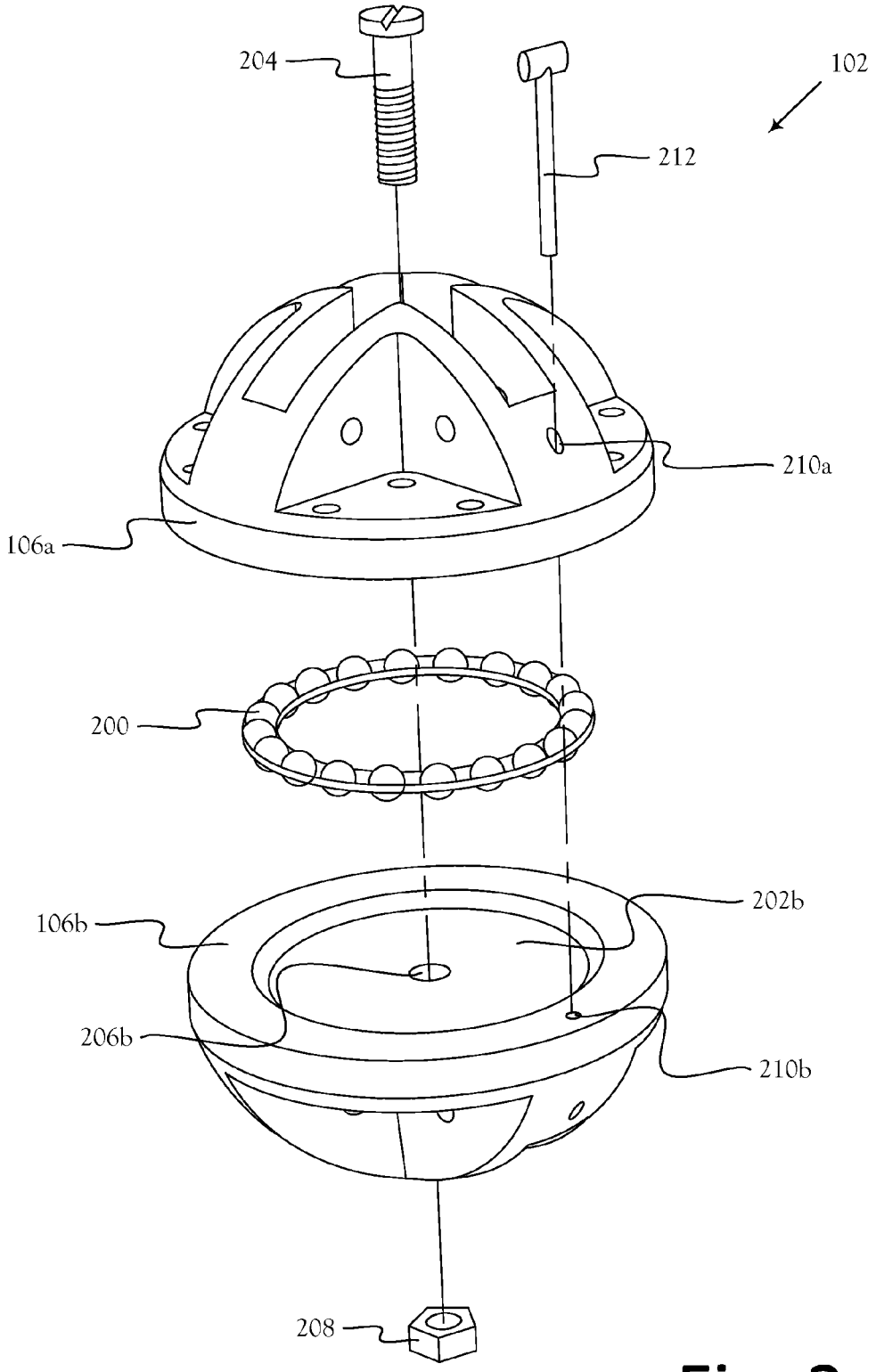
FIG. 2 shows an exploded view of one embodiment of the swivel assembly of the camp chair.

FIG. 2 illustrates an exploded view of one embodiment of the swivel assembly 102 of the camp chair 100. The swivel assembly 102 bears the primary responsibility for maintaining the proper position of each front arm 110*a*, each rear arm 110*b*, and each leg 120 when the camp chair 100 is in the operable seating configuration. The swivel assembly 102 includes a rotary bearing 200 disposed between the top member 106*a* and the bottom member 106*b*. The rotary bearing 200 facilitates rotation by reducing friction between the top member 106*a* and the bottom member 106*b*. In one embodiment, the rotary bearing 200 is a ball thrust bearing. In the illustrated embodiment, the top member 106*a* and the bottom member 106*b* cooperatively define an optional raceway 202 to receive the rotary bearing 200. Other types of rotary bearings including, but not limited to, roller thrust bearings, fluid bearings, and magnetic bearings are also functionally suitable but may be commercially less desirable due to increased cost or other factors.

The top member 106*a* and bottom member 106*b* are operatively connected by a fastener positioned at the vertical axis of the swivel assembly 102. At least the top member 106*a* freely rotates about the fastener. This allows the seat 104 to rotate relative to the base of the camp chair 100. In one embodiment, the fastener includes an elongated member 204, which passes through an axial opening 206*a* in each of the top member 106*a* aligned with an axial opening 206*b* in the bottom member 106*b*, and one or more capturing parts 208, which dimensioned larger than the central openings. The capturing parts 208 cooperate with the elongated member 204 to secure the top member 106*a*, the bottom member 106*b*, and the rotary bearing 200 together while allowing the top member 106*a* and, optionally, the bottom member 106*b* to freely rotate about the elongated member 204. An exemplary embodiment of such arrangement employs a nut and bolt to secure the top member 106*a* to the bottom member 106*b*. In an alternate embodiment, the fastener passes through the axial opening in one of the top member 106*a* and the bottom member 106*b* but directly connects to the other member. In such an embodiment, only one member would freely rotate about the fastener. An exemplary embodiment of such an arrangement employs a lag bolt with the threaded portion of the bolt engaging the threaded opening of the member. Another example of such arrangement is achieved by welding one end of the fastener to one of the top member 106*a* and the bottom member 106*b*. A still further example of such arrangement employs an integrally formed and centrally positioned elongated member extending from one of the top member 106*a* and the bottom member 106*b* rather than a separate part.

In one embodiment, the swivel assembly 102 includes an optional swivel lock selectively locks the top member 106*a* to the bottom member 106*b* to prevent the rotation of the top member 106*a* relative to the bottom member 106*b*. In one exemplary embodiment, the swivel lock includes an upper swivel lock opening 210*a* defined by the top member 106*a*, a lower swivel lock opening 210*b* defined by the bottom member 106*b*, and a swivel lock pin 212. To prevent rotation of the top member 106*a*, the swivel lock pin 212 is inserted into both the upper swivel lock opening 210*a* and the lower swivel lock opening 210*b*.

Figure 3:
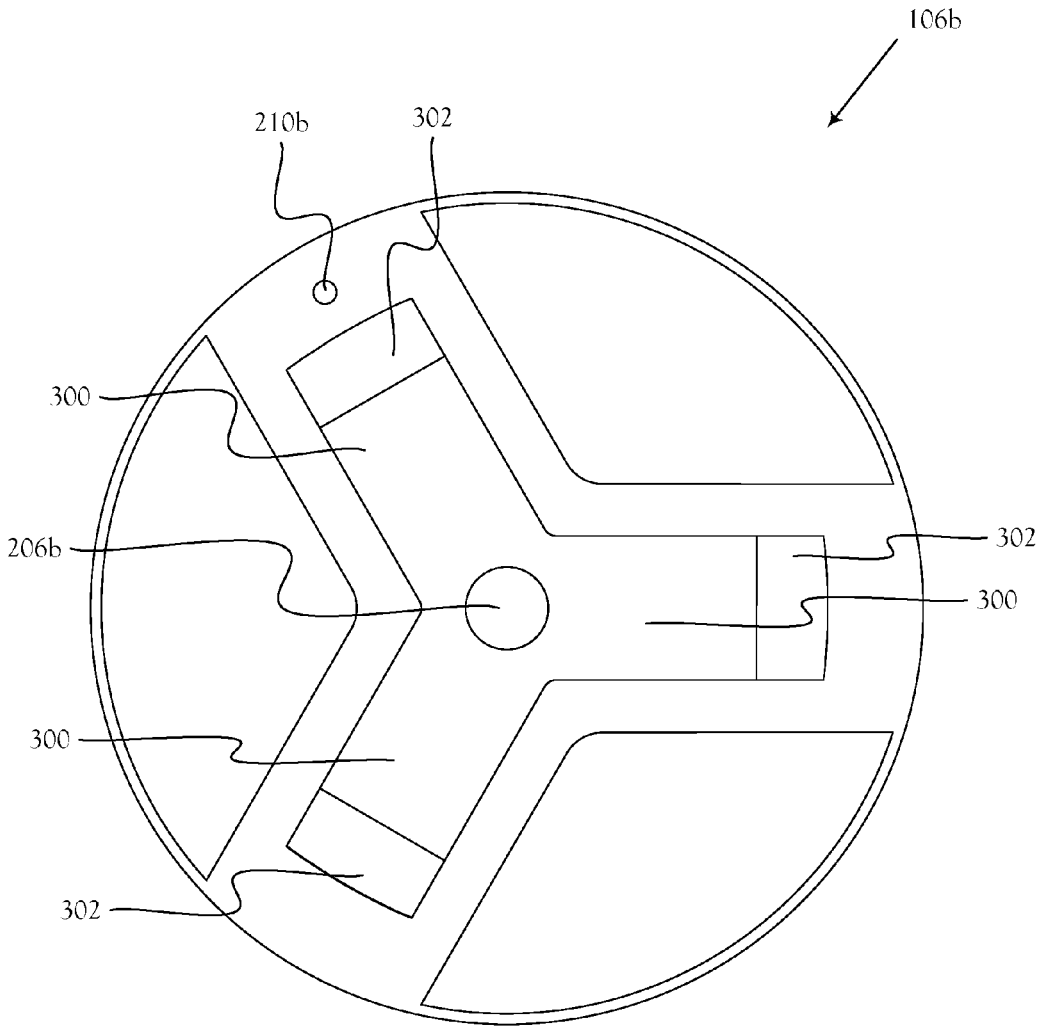
FIG. 3 shows a top plan view of one embodiment of the bottom member of the swivel assembly of the camp chair.

FIG. 3 illustrates a top plan view of one embodiment of the bottom member 106*b* of the swivel assembly 102. The bottom member 106*b* defines a number of leg channels 300 corresponding in number to the number the legs 120. Each leg channel 300 limits the movement of and provides lateral support for one of the legs 120. In the illustrated embodiment, three leg channels 300 extend radially from the center of the swivel assembly 102. Each of the three leg channels 300 is oriented at an angle of approximately 120° relative to the adjacent leg channels 300. The end wall 302 at the radial end of each leg channel 300 serves as a stop that defines the limit of outward movement for the leg 120 and, thereby, sets the angle between the leg 120 and the vertical axis of the swivel assembly 102 when the camp chair 100 is in the operative seating configuration.

In an alternate embodiment, the camp chair 100 includes four legs that are shaped substantially similar to the rear arms 110*b* illustrated in FIG. 2; however, the four legs may vary dimensionally from the rear arms 110*b*. The length of the third linear member is adjustable in a manner similar to that previously described. Each of the four legs is oriented at an angle of approximately 90° relative to the adjacent legs. In order to accommodate the additional leg, the bottom member has channels arranged substantially similar to the top member 106*a* illustrated in FIG. 4. The addition of a leg decreases the percentage of weight carried by each leg and generally improves both stability and load capacity. However, each additional leg adds an additional point of contact that complicates the leveling process.

Figure 4:
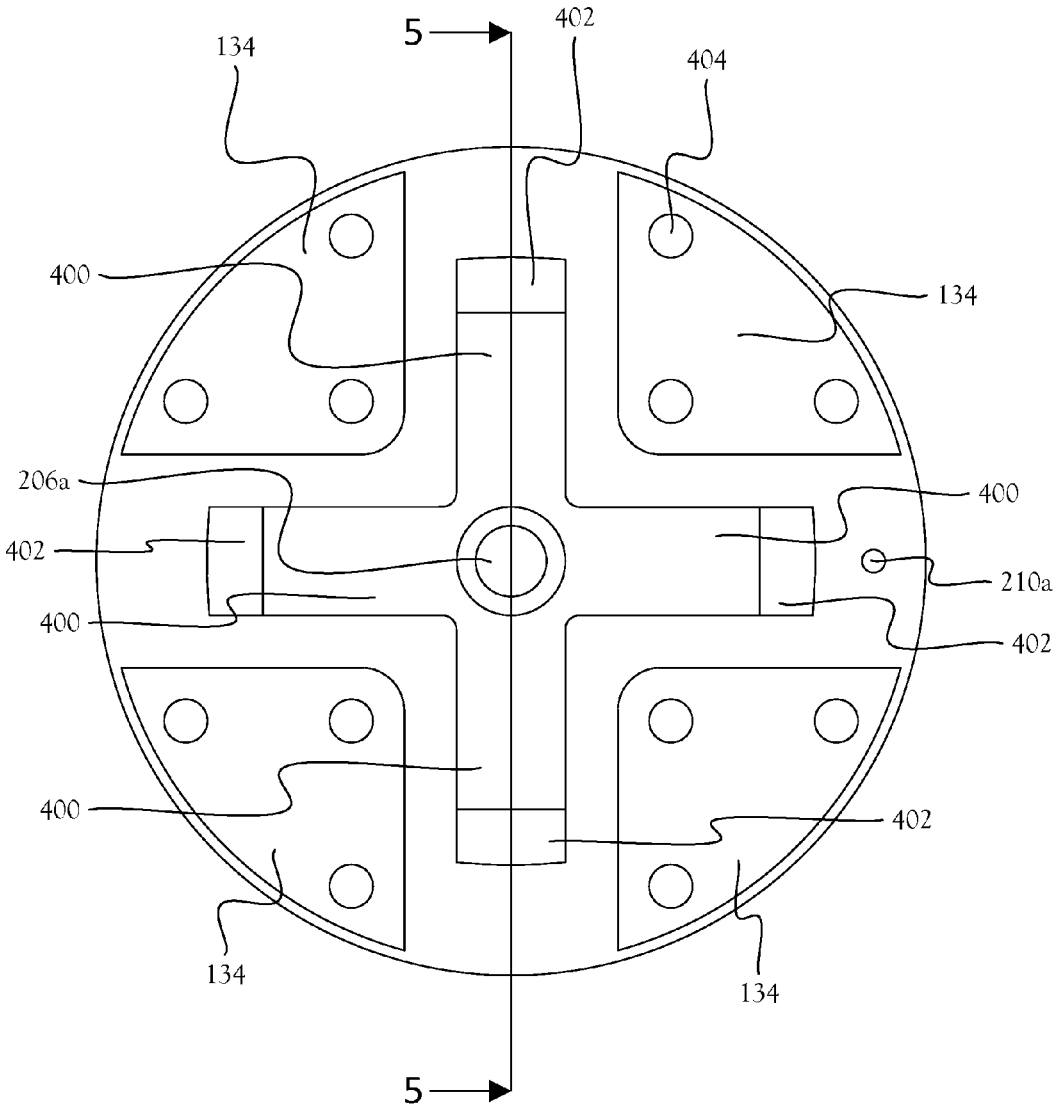
FIG. 4 shows a top plan view of one embodiment of the upper member of the swivel assembly of the camp chair.

FIG. 4 illustrates a top plan view of one embodiment of the top member 106*a* of the swivel assembly 102. The top member 106*a* is structurally and functionally similar to the bottom member 106*b*. The top member 106*a* defines a number of arm channels 400, which open upwardly and correspond in number to the number the arms 110*a*, 110*b*. Each arm channel 400 limits the movement of and provides lateral support one of the front arms 110*a* or the rear arms 110*b*. In the illustrated embodiment, four arm channels 400 extend radially from the center of the swivel assembly 102. Each of the four arm channels 400 is oriented at an angle of approximately 90° relative to the adjacent arm channels 400. In the illustrated embodiment, each attachment point 134 includes a number of fastener receptacles, e.g., threaded holes, which operatively engage the fasteners that securely mount the mounting plate 154 of the accessory arm 152 to the swivel assembly 102.

Figure 5:
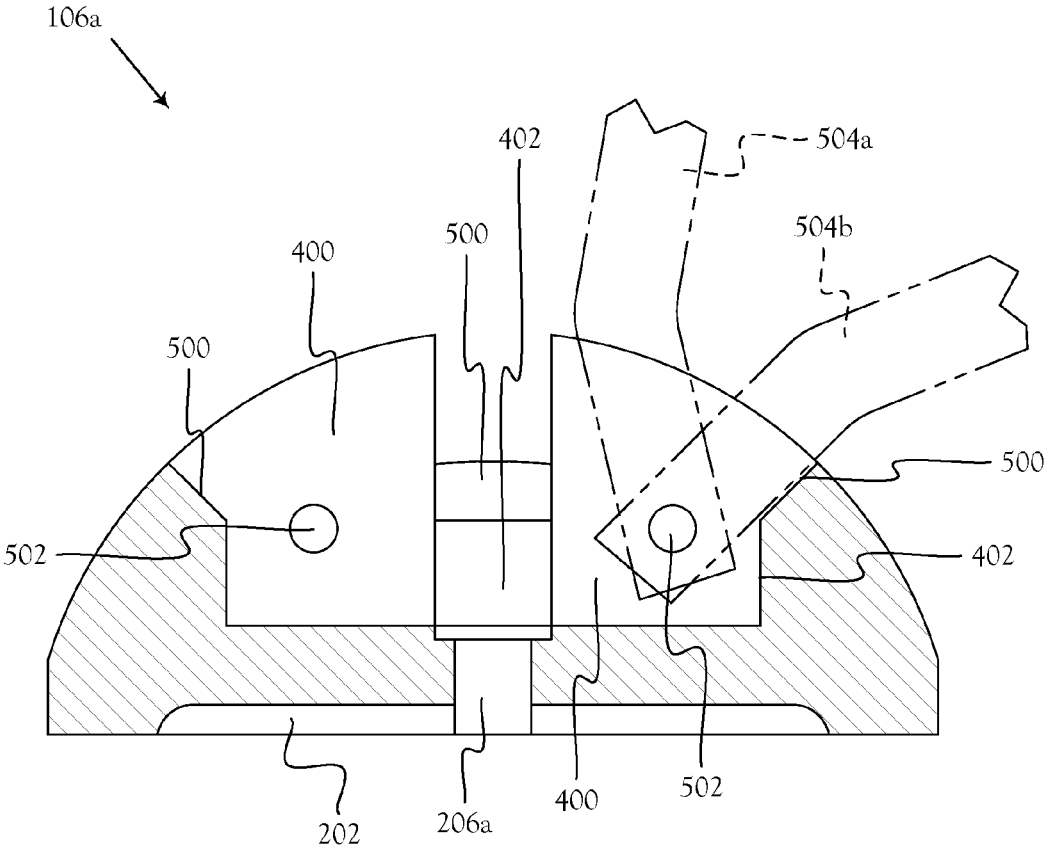
FIG. 5 shows a sectional side elevation view of one embodiment of the upper member of the swivel assembly of the camp chair taken along section line 5-5 of FIG. 4.

FIG. 5 illustrates a sectional side elevation view of one embodiment of the top member 106*a* of the swivel assembly 102. The end wall 402 serves as a stop that defines the outer limit movement for the arm 110*a*, 110*b*. When in the support position, the arm 110*a*, 110*b* engages the end wall 402 of the arm channel 400. The end walls 402 support the arms 110*a*, 110*b* in the desired position when the camp chair 100 is in the operative seating configuration and allow the arms 110*a*, 110*b* to resist the forces applied when a user occupies the camp chair 100. The camp chair 100 does not rely on the seat 104 to support the arms 110*a*, 110*b*. More particularly, the end walls 402 effectively limit the forces applied to the attachment points of the seat 104 during use because the position of the arms 110*a*, 110*b* remains fixed by the engagement of the arms 110*a*, 110*b* with the end walls 402. In one embodiment, at least a portion 500 of the end wall 402 is sloped or chamfered to reduce the force per unit area exerted on the arm 110*a*, 110*b* by increasing the surface area of the end wall 402 in contact with the arm 110*a*, 110*b*. In another embodiment, the sloped or chamfered portion of the end wall is generally concave with an inside radius complementary to the outside radius the arm in order to further increase the surface area of the end wall in contact with the arm. It should be appreciated that end walls of the bottom member 106*b* are functionally and structurally similar to end walls of the top member 106*a*. FIG. 5 also illustrates one arm of the camp chair 100 in phantom to illustrate the pivotal movement around a pivot pin 502 between the portable compact configuration 504*a* and the operative seating configuration 504*b*. For clarity, the phantom arm in the operative seating configuration 504*b* is shown slightly offset from the sloped portion 500 of the end wall 402. Those skilled in the art will appreciate that the arm would directly engage the sloped portion 500 of the end wall 402 when in the operative seating configuration 504*b*.

Figure 6:
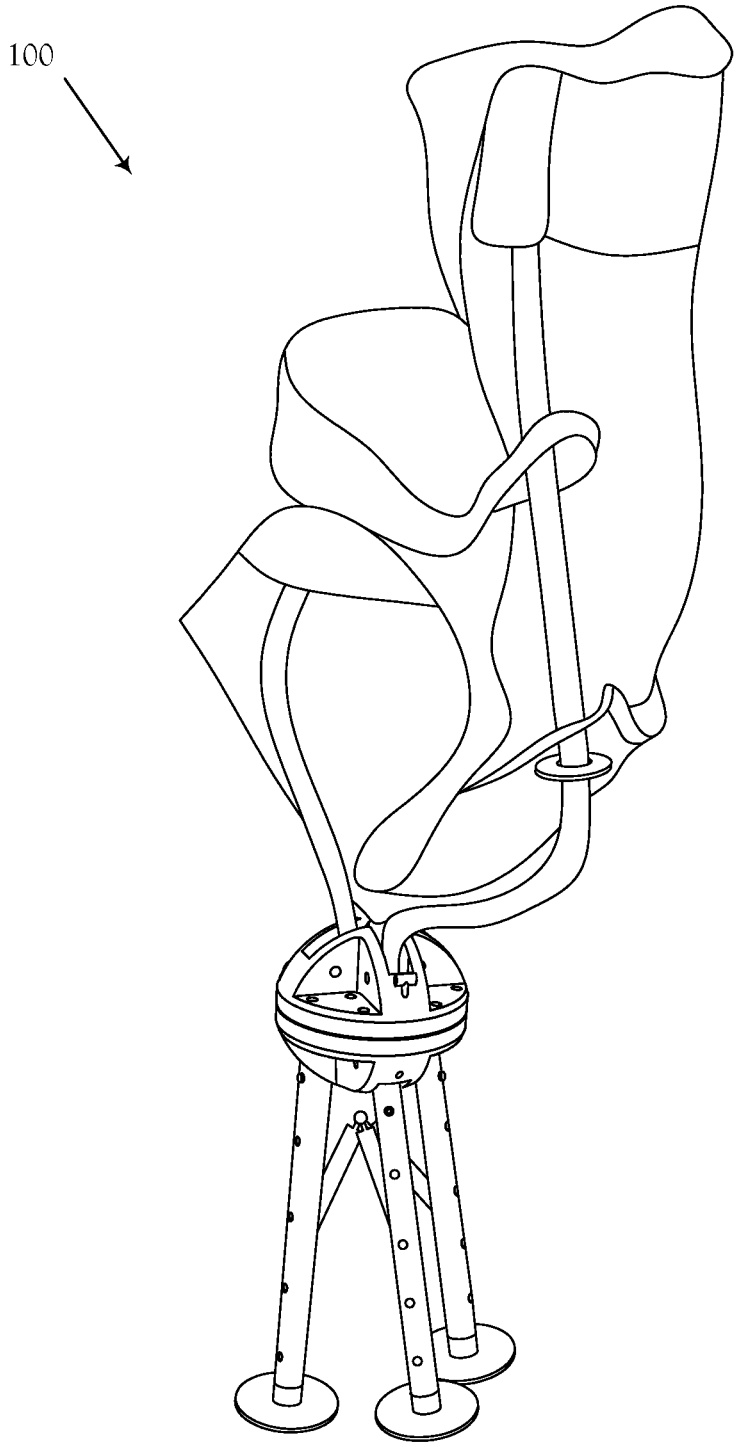
FIG. 6 shows one embodiment the camp chair in the portable compact configuration.

FIG. 6 illustrates one embodiment the camp chair 100 in the portable compact configuration. In the portable compact configuration, the arms 110*a*, 110*b* and legs 120 are pivoted toward the central longitudinal axis of the swivel assembly 102. Once collapsed into the portable compact configuration, the camp chair 100 can be stored in a bag or other similar container for protection and ease of portability.

A levelable and swiveling camp chair has been shown and described. The camp chair provides compact portability, level seating on uneven surfaces, and swivel action allowing the facing direction of the camp chair to be changed without repositioning the camp chair.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

What is claimed is:

1. A camp chair comprising:

a swivel assembly having a top member and a bottom member, said top member operably connected to said bottom member such that said top member rotates relative to said bottom member, said top member defining four upwardly opening, radial arm channels, each arm channel having an end wall;

four arms, each said arm characterized by a curvilinear shape, disposed in a separate said arm channel, and pivotally connected to said top member, each said arm selectively moveable between a carrying position and a seating position, each said arm supported by one said end wall when in said seating position;

a plurality of legs pivotally connected to said bottom member, each said leg moveable between a carrying position and a seating position, each said leg being adjustable in length;

a seat member attached to each said arm; and a plurality of accessory arm connectors positioned at different locations on said top member of said swivel assembly for selectively and directly connecting one end of an accessory arm that supports different types of accessories to said swivel assembly in a selected location based on the type of accessory supported by the accessory arm and allowing said accessory arm and said seat member to co-rotate with said top member.

2. The camp chair of claim 1 further comprising a plurality of channels defined by said top member, each said channel extending radially from a common point on said top member to a terminal end at second point on said top member, each said channel receiving one arm of said plurality of arms.

3. The camp chair of claim 1 wherein each said leg further comprises an outer tubular member telescopically connected to an inner tubular member, said inner tubular member being selectively securable at a plurality of positions along the length of said outer tubular member.

4. The camp chair of claim 3 further comprising:

a plurality of holes defined by said outer tubular member, said plurality of holes being spaced apart along the length of said outer tubular member; and a button biased to normally extend outwardly through an opening in said inner tubular member, the locking member selectively engaging one of said plurality of holes to secure said inner tubular member at a fixed axial position relative to said outer tubular member, said button selectively depressed to disengage from said plurality of holes and allow said inner tubular member to slide axially relative to outer tubular member.

5. The camp chair of claim 1 characterized in that said plurality of legs comprises three legs and each leg is substantially linear.

6. The camp chair of claim 1 further comprising a plurality of braces having first ends and second ends, said first ends hingedly connected together, each said second end hingedly connected to one of said legs, said braces lying in a substantially horizontal plane when said legs are in the seating position and being substantially parallel to said legs when said substantially linear legs are in the carrying position.

7. The camp chair of claim 1 characterized in that swivel lock comprises a first vertical opening defined by said top member, a second vertical opening defined by said bottom member, and a pin, at least one of said first vertical opening and said second vertical opening being a through opening, said pin selectively received by both said first vertical opening and said second vertical opening when said first vertical opening and said second vertical opening are aligned thereby preventing said top member from rotating relative to said bottom member.

8. The camp chair of claim 1 further comprising a further accessory arm connector located on said bottom member such that the accessory arm remains stationary as said top member rotates when selectively connected to said accessory arm connector on said bottom member.

9. The camp chair of claim 1 wherein said accessory arm connector allows one end of an accessory arm to be selectively attached to and removed from said swivel assembly.

10. The camp chair of claim 1 wherein said swivel assembly further comprises a first opening defined by said top member, a second opening defined by said bottom member, and a locking member adapted to be received by each of said first opening and said second opening and selectively prevent said top member from rotating relative to said bottom member when said locking member engages both said first opening and said second opening.

11. The camp chair of claim 1 further comprising a second plurality of accessory arm connectors positioned at different locations on said bottom member for selectively and directly connecting one end of the accessory arm that supports different types of accessories to said swivel assembly in a selected location based on the type of accessory supported by the accessory arm and allowing the accessory arm to remain stationary as said top member rotates when the accessory arm is selectively connected to one of said second plurality of accessory arm connectors.

12. A camp chair comprising:

a swivel assembly having a top member and a bottom member, said top member operably connected to said bottom member such that said top member rotates relative to said bottom member, said top member defining four upwardly-opening, radial arm channels, said top member having a plurality of accessory attachment points positioned at different locations on said top member;

a swivel lock operatively connectable to said top member and said bottom member to selectively prevent said top member from rotating relative to said bottom member;

four arms pivotally connected to said top member, each said arm disposed in a separate said arm channel and selectively moveable between a carrying position and a seating position;

three legs pivotally connected to said lower member, each said leg moveable between a carrying position and a seating position, each said leg being linear and adjustable in length;

a plurality of braces having first ends and second ends, said first ends hingedly connected together, each said second end hingedly connected to one of said legs, said braces lying in a substantially horizontal plane when said legs are in the seating position and being substantially parallel to said legs when said substantially linear legs are in the carrying position;

a seat member attached to each said arm; and an accessory arm carrying an accessory, said accessory arm having a first end selectively and directly attachable to said swivel assembly via at least one of said accessory attachment points depending upon the type of accessory carried by said accessory arm.

13. The camp chair of claim 12 characterized in that said swivel lock comprises a first opening defined by said top member, a second opening defined by said bottom member, and a locking member adapted to be received by each of said first opening and said second opening and selectively preventing said top member from rotating relative to said bottom member when said locking member engages both said first opening and said second opening.

14. The camp chair of claim 12 wherein said bottom member further comprises at least one accessory attachment point such that an accessory carried by an accessory arm is located at a fixed position with respect to the bottom member and remains in the fixed position as the seat member rotates.

15. A camp chair comprising:

a bottom swivel member defining four downwardly-opening leg channels;

a top swivel member defining four upwardly-opening arm channels, the top swivel member rotating relative to bottom swivel member;

a plurality of accessory arm connection points positioned at different locations on the top swivel member, the accessory arm connection points allowing an accessory arm to be selectively attached to and removed from the camp chair;

four arms carried by the top swivel member, each arm pivotally connected in one of the arm channels, the arms moveable between a seating position and a carrying position;

three legs carried by the bottom swivel member, each leg pivotally connected in one of the leg channels, each leg being substantially linear, each leg being independently adjustable in length, each leg being moveable between a seating position and a carrying position; and a seat attached to each arm and forming a seating area when the arms are pivoted to the seating position, the seat co-rotating with the top swivel member.

16. The camp chair of claim 15 further comprising an accessory arm selectively attachable to and removable from the accessory arm connection point, the accessory arm carrying an accessory, the accessory either remaining stationary or co-rotating with the seat member as the top swivel member rotates depending upon the location of the accessory arm connection point to which the accessory arm is attached.

17. The camp chair of claim 15 wherein the accessory arm connection point is located on the top swivel member such that an accessory carried by an accessory arm is located at a fixed position with respect to the seat member and co-rotates with the seat member as the top swivel rotates.

18. The camp chair of claim 17 further comprising a further accessory arm connection point located on the bottom swivel member such that an accessory carried by an accessory arm selectively connected to said accessory arm connection point on said bottom swivel member is located at a fixed position with respect to the bottom swivel member and remains in the fixed position as the seat member rotates.

19. The camp chair of claim 15 further comprising a plurality of braces having first ends and second ends, the first ends hingedly connected together, each second end hingedly connected to one of the legs, the braces lying in a substantially horizontal plane when the legs are in the seating position.

20. The camp chair of claim 15 further comprising a second plurality of accessory arm connection points positioned at different locations on said bottom swivel member for selectively and directly connecting one end of the accessory arm that supports different types of accessories to said bottom swivel member in a selected location based on the type of accessory supported by the accessory arm and allowing the accessory arm to remain stationary as said top member rotates when the accessory arm is selectively connected to one of said second plurality of accessory arm connection points.

* * * * *